United States Patent [19]

Maxhimer

[11] 4,445,238

[45] May 1, 1984

[54] SWIMMING POOL WATER LEVEL CONTROL APPARATUS

[76] Inventor: Monroe R. Maxhimer, 10202 N. 46th Ave., Glendale, Ariz. 85302

[21] Appl. No.: 426,988

[22] Filed: Sep. 29, 1982

[51] Int. Cl.[3] ..... E04H 3/18

[52] U.S. Cl. ..... 4/508; 4/509; 73/290 R; 73/308; 73/432.1; 137/392; 137/393; 210/127

[58] Field of Search ..... 4/508, 509, 302; 73/432 R, 290 R, 52, 308; 137/426, 392, 428, 393, 400, 412; 210/127; 222/51; D40/619, 624

[56] References Cited

U.S. PATENT DOCUMENTS

| | | | |
|---|---|---|---|
| 352,647 | 11/1886 | Ghegan | 73/308 |
| 2,305,102 | 12/1942 | O'Neil | 73/290 R |
| 3,339,578 | 9/1967 | Smith | 137/392 |
| 3,446,222 | 5/1969 | Barker | 137/392 |
| 3,596,673 | 8/1971 | Laucournet | 137/392 X |
| 3,759,286 | 9/1973 | Page | 137/392 |
| 3,916,926 | 11/1975 | Smolin et al. | 137/392 X |
| 4,014,010 | 3/1977 | Jinotti | 222/51 |
| 4,069,838 | 1/1978 | Hansel et al. | 137/392 |
| 4,235,829 | 11/1980 | Partus | 137/392 X |
| 4,342,125 | 8/1982 | Hodge | 4/508 |
| 4,370,418 | 1/1983 | Koopman et al. | 137/393 X |
| 4,407,159 | 10/1983 | Wytaniec | 137/393 X |

*Primary Examiner*—Henry K. Artis

*Attorney, Agent, or Firm*—H. Gordon Shields

[57] ABSTRACT

Swimming pool water level control apparatus includes a remote indicator for sensing the water level in a swimming pool and for turning on and off a water flow control valve to provide water for the swimming pool.

6 Claims, 4 Drawing Figures

POWER SUPPLY
+18 VP DC
±15 VDC
+15 V DC
+15 DC
25 VAC
L.E.D. DRIVER
PHOTO-DETECTION AMPLIFIER
LOW PASS FILTER
TIMER
SOLENOID DRIVER
SOLENOID POWER INDICATOR
TIMER ON IN DICATOR
25 VAC
SOLENOID
WATER SOURCE

SWIMMING POOL WATER LEVEL CONTROL APPARATUS

BACKGROUND OF THE INVENTION

1. Field of the Invention

This invention relates to swimming pools and, more particularly, to apparatus for sensing the height of water in a swimming pool and for controlling the flow of water to the swimming pool from a location remote from the swimming pool.

2. Description of the Prior Art

There are several ways to control the height of water in a swimming pool. The simplest way to control the height of water in a swimming pool is by visual observation of the height of water in the pool, and upon visually determining that the water level is low, turning on a valve that allows water to flow to the swimming pool until the desired water level is observed. When the desired water level is observed, the water valve is manually closed, stopping the flow of water to the swimming pool.

There have been other systems suggested for automatically controlling the height of water in a swimming pool, one such being suggested by U.S. Pat. No. 2,739,939. In the '939 patent, a float control operates a valve when the water level is low. When the water level is brought to a predetermined height, the float rises and turns off the valve. The system is not unlike the conventional float control valve used to control the height of water in a toilet tank.

Another automatic system for controlling the height of water in a swimming pool is shown in U.S. Pat. No. 3,908,206. The swimming pool in the '206 patent is an above-ground swimming pool, and the water height control system is disposed adjacent to the swimming pool. A float is again used to control a valve which turns on and off a flow of water.

In addition to the two patents discussed above, there have been other patents which include systems for automatically sensing the level of a liquid. Such liquid level patents include U.S. Pat. No. 352,647, U.S. Pat. No. 2,070,617, U.S. Pat. No. 2,305,102, and U.S. Pat. No. 4,014,010.

While none of the four patents identified in the preceding paragraph are concerned with swimming pools, they each include means for sensing the height of a liquid in a tube of some type. In the '647 patent, a light source and a light sensitive element are disposed on opposite sides of a tube, with an opaque float disposed in the tube. The float is disposed between the light and the light sensitive element. When the float sinks with the level of the liquid in the tube, the resistance in an electrical circuit is changed and an alarm bell sounds.

In the '617 patent, light sources and light sensitive elements are disposed on opposite sides of a tube in which the water level is indicated. An opaque float is also used in the tube. The changing water level causes the float to move, thus allowing light rays from the light sources to impinge upon light sensitive elements. Appropriate relays are used to control the flow of the water between the predetermined minimum and maximum heights.

A light beam is used in conjunction with the '102 patent, but no float is used.

In the '010 patent, a light source and a photo cell are disposed on opposite sides of a tube and an opaque float is disposed within the tube. Movement of the opaque float with respect to the light source and the photo cell controls an electrical circuit. When the float drops from between the light source and photo cell, an output to an alarm system which is activated, indicating that the fluid level has dropped below a predetermined minimum.

In the two groups of patents, the patents concerned with swimming pools utilize floats to control the flow of water to a swimming pool. In the second group of patents, which have nothing to do with swimming pools, tubes are connected to a liquid tank of some kind, and a sensing system is used to determine the height or quantity of liquid (water) in the tank. In the '617 patent, the liquid sensing system also results in the actuation of a valve to keep the level in a boiler within predetermined limits. However, the other patents in the group are simply for reference purposes with respect to the height of the liquid and are not connected to a fill system. Moreover, all of the systems, in both groups of patents, are disposed adjacent to the liquid supply whose height they are concerned with. For swimming pools, it is advantageous to have the height sensing apparatus, particularly if it is associated with electricity, to be located remotely from the swimming pool so as to isolate the electrical system from the water system as much as possible. The apparatus of the present invention includes the remote sensing of the water height of a swimming pool and the electrical system(s) associated with the sensing and control system is thus isolated from the swimming pool.

SUMMARY OF THE INVENTION

The apparatus of the present invention includes a water level sensing system for a swimming pool, with the sensing system located remotely from the swimming pool, and a control system associated with the liquid level system for controlling or activating a water supply valve which in turn controls a flow of water to the swimming pool. Among the objects of the present invention are the following:

To provide new and useful apparatus for sensing the height of water in a swimming pool;

To provide new and useful apparatus for controlling the water flow for filling a swimming pool;

To provide new and useful apparatus for remotely sensing the height of water in a swimming pool;

To provide new and useful apparatus for controlling the flow of water to a swimming pool to keep the water level within predetermined limits; and To provide new and useful apparatus for electrically sensing the height of water in a swimming pool and for filling the swimming pool in response to the sensed water height.

DESCRIPTION OF THE PREFERRED EMBODIMENT

Figures 1, 2, 3A, 3B:
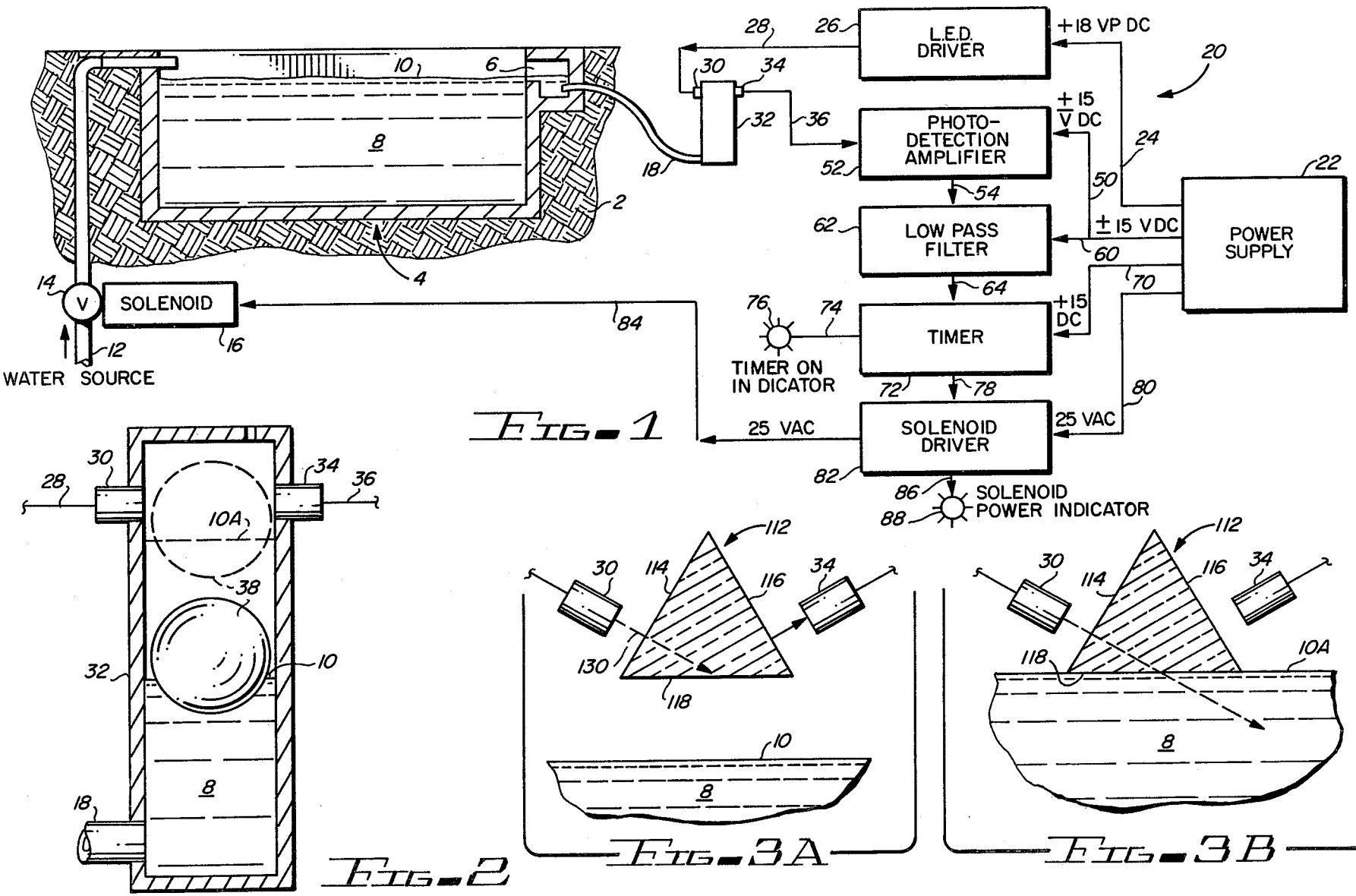
FIG. 1 is a schematic representation of a swimming pool and the height sensing system and circuitry associated therewith.
FIG. 2 is an enlarged view in partial section of a portion of the apparatus of FIG. 1.
FIG. 3A is an enlarged schematic view of an alternate embodiment of the apparatus of the present invention.
FIG. 3B is an enlarged view in partial section of the apparatus of FIG. 3 showing the sequential operation of the apparatus.

FIG. 1 is a schematic representation of a swimming pool 4 disposed within ground 2, with the swimming pool 4 having therein water 8. The swimming pool 4 includes a gutter 6 which typically extends about the periphery of the swimming pool. In the alternative to using a gutter, a skimmer reservoir may be used. This will be discussed in detail below. The top of the water, or the water level, is designated by reference numeral 10. A water supply line 12 is shown extending to the swimming pool 4. The water supply line 12 includes a valve 14 controlled by a solenoid 16. When the valve 14 is opened by the solenoid 16, water flows through the supply line 12 to provide a supply of water to the pool 4. When the valve 14 is closed, no water flows to the swimming pool. The activation of the solenoid 16 controls the valve 14 and thus allows water from the line 12 to flow to the swimming pool 4. A control system, part of the apparatus of the present invention, in turn controls the solenoid 16.

Operation of the solenoid 16 is accomplished by swimming pool water level control apparatus 20. The swimming pool water level control apparatus 20 includes a power supply 22 which is connected to an ordinary 120 volt household electrical supply line, not shown. The power supply 22 provides the various direct current and alternating current voltages required for the operation of the several electrical elements included in the control apparatus 20.

A conductor 24, which is preferably an eighteen-volt pulsating positive dc line, extends from the power supply 22 to a light emitting diode driver 26. The light emitting diode (LED) driver 26 is in turn connected to a light emitting diode 30 by a conductor 28. The LED 30 is disposed on one side of a cylinder 32. An appropriate photodetector 34 is disposed diametrically opposite to the LED 30 at the upper portion of the cylinder 32. The cylinder 32 is located remotely from the swimming pool 4 and is connected thereto by a capillary tube 18.

The capillary tube 18 is a conduit which extends to the cylinder 32 from the gutter 6, or from a skimmer reservoir at one point on the periphery of the pool 4 where water is drawn from the pool at the level 10 of the water 8. That is, the water level of the gutter or the skimmer reservoir reflects the water level 10 of the water 8 in the pool 4. The tube or conduit 18 receives the flow of water from the gutter or skimmer reservoir 6. The water accordingly flows from the element 6 through the tube 18 to the cylinder 32. The water within the cylinder 32 thus reflects the height or level 10 of the water in the swimming pool 8.

Obviously, the cylinder 32, though located remotely from the swimming pool 4, is disposed at a height which corresponds to the height 10 of the water 8 in the swimming pool 4. This is best illustrated by reference to FIG. 2, which comprises an enlarged view in partial section of the cylinder 32. FIG. 2 also shows the LED 30, the photodetector 34, and the water 8. It will be noted that the water level line 10 in FIG. 2 corresponds to the water level line 10 in FIG. 1. The two water levels are the same due to the connection of the tube or conduit 18 between the swimming pool 4 and the cylinder 32.

The cylinder 32 is appropriately vented to allow atmospheric pressure within the cylinder 32 to allow for the free fluctuation of the level of the water 8 within the cylinder 32. The level 10 thus reflects the true level of the water 8 corresponding to the level of the water 8 in the pool 4.

The photodetector 34 is connected to a photodetection amplifier 52 by a conductor 36. Current for the photodetection amplifier 52 is provided by a conductor 50 which extends from the power supply 22 to the amplifier 52. The power supply 22 provides preferably fifteen volts of direct current, both positive and negative voltage, for the photodetector amplifier 52. When light from the LED 30 impinges on the photodetector 34, a relatively small current is generated by the photodetector 34 and is transmitted to the photodetection amplifier 52 on the conductor 36. The signal from the photodetector 34 is in turn amplified, and the amplified signal is transmitted on a conductor 54 to a low pass filter 62. The low pass filter 62 is connected to the power supply 22 by a conductor 60, which extends from the conductor 50 to the filter 62.

The filtered signal from the filter 62 is transmitted to a timer 72 by a conductor 64. The timer 72 is connected to the power supply 22 by a conductor 70. The conductor 70 preferably provides plus fifteen volts of direct current to the timer 72. For convenience, a visual indicator, such as a light 76, is connected to the timer 72 by a conductor 74. The light 76 provides a visual indication, when illuminated, that the timer 72 has been activated.

Activation of the timer 72 by an appropriate signal originating with the photodetector 34 also actuates a solenoid driver 82. The timer 72 is connected to the solenoid driver 82 by a conductor 78. The solenoid transmits twenty-five volts of alternating current from the power supply 22 to the solenoid driver 82. The solenoid driver 82 is connected to the solenoid 16 by a conductor 84. The conductor 84 extends from the solenoid driver 82 to the solenoid 16 for actuating the solenoid 16. A visual indication that the solenoid driver is actuated is also provided by a light 88 which is connected to the driver 82 by a conductor 86. The solenoid driver 82 connects and disconnects the conductors 80 and 84 to actuate and to turn off the solenoid 16.

Referring again to FIG. 2, it will be noted that the cylinder 32 also includes an opaque float 38. The float 38 moves vertically upwardly and downwardly within the cylinder 32 in response to the rising and falling of the level 10 of the water 8. When the water level line 10 is in the position shown in FIG. 2, the opaque float 38, which is preferably a ball, is moved downwardly from between the LED 30 and the photodetector 34. This allows the lignt from the LED 30 to impinge directly on the photodiode 34. The photodiode 34 then produces an output signal which is transmitted on conductor 36 to the photodetection amplifier 52.

The rising of the water level in the cylinder 32 causes the float 38 to move upwardly. When the water level is at the position 10A, shown in dotted line in FIG. 2, the float 38 is disposed between the LED 30 and the photodetector 34, thus blocking the light between the LED 30 and the photodetector 34. When the light to the photodetector 34 is blocked, the output signal from the photodetector 34 ceases and no signal is transmitted to the amplifier 52.

With the falling of the water level 10 downwardly from the position 10A shown in FIG. 2, the float 38 drops below the LED 30 and the photodetector 34 and thus allows a signal to be transmitted from the photodetector 34 on conductor 36 to the photodetector amplifier 52. The signal is amplified by the amplifier 52 and is then transmitted to the low pass filter 62 by the conductor 54. The filter 62 allows only an appropriate signal to be transmitted on conductor 64 to the timer 72, and insures that spurious signals are rejected.

When a signal is received by the timer 72, the timer is actuated for a predetermined period of time. The actuation of the timer 72 for the predetermined period of time causes or allows the solenoid driver 82 to be actuated for the predetermined period of time. In turn, the solenoid 16 is actuated to allow the valve 14 to be opened, or to open the valve 14, for the predetermined period of time. Thus, water through the line 12 flows to the swimming pool 4 for a predetermined time period after the timer 72 is initially actuated by a signal from the photodetector 34.

The actuation of the timer 72, the driver 82, and the solenoid 16 for a predetermined time period prevents a miscellaneous or momentary fluctuation in the water level of the swimming pool 4 from turning on and off the solenoid driver 82 and its solenoid 16. Without the timer, a relatively small fluctuation in the water level, perhaps caused by splashing adjacent to the area of the gutter 6 in which the tube or conduit 18 is located, could give an erroneous indication of the height of the water, thus turning on and off the solenoid 16 and the valve 14 for relatively short periods of time.

The timer 72, once actuated by the falling or lowering of the water level 10 in the cylinder 32, operates for a predetermined time to allow a predetermined amount of water 8 to flow into the swimming pool 4. The time period is, of course, correlated with the flow of water, namely the theoretical amount or quantity of water required to raise the water level from the low or actuation level to the deactivation level 10A (as shown in FIG. 2).

If, during that predetermined time period, the level 10 of the water 8 rises to the "full" position 10A, as shown in FIG. 2, thus causing the float 38 to come between the LED 30 and the photodetector 34, the timer 72, the solenoid driver 82, and the solenoid 16 will not turn off, and thus the valve 14 will not be closed. Rather, once actuated, the timer 72, the driver 82, and the solenoid 16 remain actuated for the full predetermined time period. This should result in the filling of the pool to the proper height or level. However, a slight overfilling may also occur.

On the other hand, if the predetermined time period for the timer, driver, and solenoid is not sufficient to provide enough water 8 to raise the water level 10 to the full position 10A, then the float 28, which would still be below the level of the LED 30 and the photodetector, would not block the continuing signal generated by the LED 30 and the photodetector 34. In such case, the timer 72 would be actuated for another predetermined time period, which is the same predetermined time period, to provide the same amount of water as provided previously to the pool 4. The rising of the water 8 to the level 10A, regardless of the number of consecutive time periods actuated by the signal from the detector 34, would eventually result in the float 38 breaking the light beam between the LED 30 and the photodetector 34, thus turning off the signal on the conductor 36 to the amplifier 52. The breaking of the signal, though, would not cause a cessation of the appropriate current flows from the power supply 22 to the timer 72, solenoid driver 82, and solenoid 16 until the end of the particular predetermined time period.

It has been discussed above that the timer 72 is actuated for a predetermined time period and it in turn actuates the solenoid driver for the predetermined time period. Thus, once the timer is actuated, it remains "on" for a predetermined time period, also providing that the solenoid driver 82 and the solenoid 16 are both actuated for the same predetermined time period. The fluctuation of the level 10 of the water 8 within the cylinder 32 during that predetermined time period will have no effect on the timer 72, the solenoid driver 82, and the solenoid 16. Accordingly, water from the pipe 12 will flow through the opened valve 14 during the predetermined time period regardless of the status of the float 38 with respect to the water levels 10 or 10A in the swimming pool 4 and in the cylinder 32. The use of the predetermined time period prevents the nearly constant turning on and off of the water flow in response to relatively minimal fluctuations in the level 10 of the water 8. Also, as has been stated, if the water flow during the predetermined time period that the valve 14 is open in response to actuation of the solenoid 16 does not raise the float 38 within the cylinder 32 sufficiently to break the light beam from the LED 30 to the photodetector 34, the continuing signal from the photodiode 34 to the amplifier 52, the filter 62, and to the timers 72 will result in a second sequential actuation of the timer 72, the driver 82, and the solenoid 16, or continuing sequential actuations until such time as the float 38 is raised sufficiently to break the light beam between the LED 30 and the photodetector 34.

In FIG. 1, the control portion of the invention, including the power supply 22, the LED driver 26, the photodetection amplifier 52, the low pass filter 62, the timer 72, and the solenoid driver 82, with their associated conductors and indicator lights, may be located at a convenient location with respect to the cylinder 32. The control system may be located remotely from or adjacent to the cylinder 32, as desired. The control system may also be located at a location either adjacent to or remote from the solenoid 16 which, obviously, must be located adjacent to the valve 14 in the water line 12.

Where water is involved, it is best, for reasons of safety, to have electrical elements located as remotely from the water as possible to minimize the likelihood of an accident. It will be noted that the voltages involved in the apparatus of the present invention, and as discussed above, and which are only illustrative, are relatively low voltages for both the direct current and the alternating current elements involved. Obviously, the voltages involved with components of various designs, but still within the general purview of the design discussed herein, may vary.

The cylinder 32, which includes its LED 30 and its photodiode 34, both of which elements involve electrical current, may also be located remotely from the swimming pool 4 to minimize the hazards of water and electricity. The swimming pool 4 and the cylinder 32 are connected by the tube or conduit 18. The length of the conduit 18 is relatively immaterial, and thus the cylinder 32 may be located with respect to the pool 4 virtually as desired by particular users.

Of substantial importance with respect to the location of the cylinder 32 and the pool 4 is the relative vertical orientation of the cylinder 32. That is, the cylinder 32 must be located at a height commensurate with the expected height or level 10 (or 10A, as shown in FIG. 2) of the water 8 since the water 8 will seek its own level in both the pool 4 and the cylinder 32 by means of the tube 18.

Referring again to FIG. 2, it will be noted that the float 38 moves in response to the height or level 10 of the water 8 in the cylinder 32. The LED 30 and the photodetector 34 are disposed diametrically opposite each other in the cylinder 32. They are located with respect to the water 8 so that the rising level 10 of the water 8 causes the float 38 to come between them and thus interrupt the light beam from the LED 30 to the photodetector 34. However, if for some reason the level of the water 8 does not stop at or near the maximum anticipated level 10A, it is possible for the water level to rise to that of the electrical elements 30 and 34, or even above them. Even though such possibility is remote due to the design of the present apparatus with the predetermined time period for the flow of the water, some event, such as a major splash of the water, could cause the level 10 of the water 8 to rise at or near the electrical elements 30 and 34, thus posing a potential problem, even though the elements may be sealed in the cylinder 32. Nevertheless, the presence of the water near the electrical elements 30 and 34 and the cylinder 32 may pose a hazard.

Even though a potential hazard is extremely remote, it may be well to provide a system in which even the electrical components are located remotely from the potential water level(s) 10 or 10A. Such an alternate embodiment of the float system illustrated in FIG. 2 is illustrated in FIGS. 3A and 3B.

FIGS. 3A and 3B illustrate an alternate embodiment of part of the apparatus of the present invention and sequentially show the rise of the water 8 from a lower level 10 in FIG. 3A to a higher level 10A. The water level 10A, shown in FIG. 3B, is the preferred maximum predetermined water height for the water 8 in the swimming pool 4.

In the alternate embodiment of FIGS. 3A and 3B, the LED 30 and the photodetector 34 are used. However, instead of using a float 38, a prism 112 is used. The prism 112 is fixed in place, and thus does not move. The LED 30 and the photodetector 34 may be positioned away from the prism 112 so that the rising water level, even if it exceeds the level of 10A shown in FIG. 3B, will not come close to the electrical elements 30 and 34. However, for convenience, the elements 30 and 34 are shown relatively close to the prism 112, and even then are disposed substantially above the maximum desired water level 10A.

The prism 112 includes three sides 114, 116, and 118. The side 118 is a bottom and is aligned substantially parallel to the top of the water 8. The LED 30 is disposed or oriented along the side 114, and is spaced apart therefrom. The photodetector 34 is aligned with and spaced apart from the side 116. In practice, light beams 130 from the LED 30 enter the prism 112 through the side 114 and are refracted in the prism and exit the prism 112 through the side 116. The exiting light beams impinge on the photodetector 34 and thus result in an output signal from the photodetector 34. The above process is accomplished so long as the level or height 10 of the water 8 is below, and thus not in contact with, the bottom 118 of the prism 112. This is illustrated in FIG. 3A.

In FIG. 3B, the water level 10A has risen from the height 10 shown in FIG. 3A and is in contact with the bottom 118 of the prism 112. When the water contacts the bottom of the prism, the light refracting characteristics of the prism change, and the light from the LED 30 no longer is refracted outwardly from the side 116. Rather, the light continues through the prism and into the water 8. With the light extending into the water 8, the photodetector 34 no longer provides an output, and the signal from the photodetector 34 turns off, thus indicating no need for water through the line 12 to the pool 4.

As long as the level of the water 8 is touching the bottom side 118 of the prism 112, light from the LED 30 will continue to pass through the prism 112 and into the water 8 instead of being refracted into the photodetector 34. However, when the water level drops below the bottom side 118, the light from the LED 30 will then be refracted from the side 116 into the photodetector 34. The output signal from the photodetector 34 will then be transmitted to the photodetector amplifier 52, the low pass filter 62, and the timer 72 and will result in the actuation of the solenoid driver 82 and the solenoid 16 to allow water to flow through the line 12 into the pool 4 for the predetermined time period, all as discussed above.

As previously stated, when the timer 72 is actuated, its indicator light 76 will be illuminated to provide a visual indication that the timer is actuated. Similarly, actuation of the solenoid driver 82 will also be indicated visually by the illumination of its indicator light 88.

With the prism 112 fixed in place, there are no moving parts except for the movement of the water 8 in both the swimming pool 4 and the cylinder 32. Again, with the prism 112 fixed in place, the electrical elements 30 and 34 may be located relatively remotely from the prism with respect to the cylinder 32 to substantially obviate the likelihood of contact between the water 8 and the electrical elements 30 and 34. Thus the embodiment of FIGS. 3A and 3B may provide a safety enhancement over the utilization of the float system as shown in FIG. 2.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications of the invention. This specification and the appended claims have been prepared in accordance with the applicable patent laws and the rules promulgated under the authority thereof.

What is claimed is:

1. Swimming pool water level control apparatus, comprising, in combination:

means for sensing the water level in the swimming pool located remotely from the swimming pool, including means for sensing a preferred water level in the pool and for sensing a water level less than the preferred water level; and control means for controlling water flow to the swimming pool in response to the means for sensing the water level, including means for providing a first output signal in response to the sensing of a water level less than the preferred water level, timer means actuated by the first output signal for providing a second output signal for a predetermined time period, valve means for controlling a flow of water to the swimming pool, and means activated by the second output signal for opening the valve means for the predetermined time period to allow water to flow to the swimming pool during the predetermined time period.

2. The apparatus of claim 1 in which the means for sensing the water level in the swimming pool further includes a cylinder for receiving water from the swimming pool and located remotely from the swimming pool, and a conduit extending from the swimming pool to the cylinder through which water flows to the cylinder for indicating the height of the water in the swimming pool.

3. The apparatus of claim 2 in which means for sensing the preferred water level and a water level less than the preferred water level includes means for generating a light beam, means for generating an output signal in response to the generated light beam, and means for interrupting the light beam in response to the level of the water at the preferred water level.

4. The apparatus of claim 3 in which the means for interrupting the light beam comprises a float movable vertically in response to the water level.

5. The apparatus of claim 3 in which the means for interrupting the light beam comprises a prism disposed within the cylinder whose light refracting characteristics change in response to the level of the water.

6. The apparatus of claim 3 in which means activated by the second output signal includes a solenoid for opening the valve means.

* * * * *